United States Patent [19]

Walt et al.

[11] 4,312,164

[45] Jan. 26, 1982

[54] INSULATING BONDED MASONRY

[75] Inventors: Hans Walt, Schlatt; Peter Keller, Pfungen, both of Switzerland

[73] Assignee: Keller AG Ziegeleien, Pfungen, Switzerland

[21] Appl. No.: 118,416

[22] Filed: Feb. 4, 1980

[30] Foreign Application Priority Data

Feb. 16, 1979 [CH] Switzerland ..... 1574/79

[51] Int. Cl.[3] ..... E04B 2/02

[52] U.S. Cl. ..... 52/405; 52/561

[58] Field of Search ..... 52/405–412, 52/569, 570, 571, 572, 437, 438, 404, 561

[56] References Cited

U.S. PATENT DOCUMENTS

| | | | |
|---|---|---|---|
| 1,621,957 | 3/1927 | Schweizer | 52/412 |
| 1,649,481 | 11/1927 | McWane | 52/410 |
| 2,004,739 | 6/1935 | Whritenour | 52/410 |
| 2,326,708 | 8/1943 | Wanner | 52/438 |
| 3,982,369 | 9/1976 | Keleske | 52/407 |
| 4,123,881 | 11/1978 | Muse | 52/438 |

FOREIGN PATENT DOCUMENTS

| | | | |
|---|---|---|---|
| 257885 | 10/1967 | Austria . | |
| 270954 | 5/1969 | Austria | 52/569 |
| 862656 | 12/1953 | Fed. Rep. of Germany | 52/569 |
| 1935706 | 3/1966 | Fed. Rep. of Germany . | |
| 1708765 | 4/1970 | Fed. Rep. of Germany . | |
| 29540 | 7/1958 | Finland | 52/408 |
| 463062 | 11/1968 | Switzerland | 52/603 |
| 507425 | 6/1971 | Switzerland . | |

*Primary Examiner*—James L. Ridgill, Jr.
*Attorney, Agent, or Firm*—Werner W. Kleeman

[57] ABSTRACT

An insulating bonded masonry or brickwork contains insulating layers formed of insulating material in the vertical joints disposed parallel to the brickwork plane between the bricks. These insulating layers extend at least at one bearing or support joint up to the neighboring bricks. The bricks neighboring the insulating layers in vertical direction possess continuous holes extending from bearing side to bearing side. To improve the insulating properties of the bonded masonry or brickwork at least the holes neighboring the insulating layers are filled with insulating material and the insulating layer is connected at least at one bearing side with the insulating material of the bricks.

16 Claims, 7 Drawing Figures

INSULATING BONDED MASONRY

BACKGROUND OF THE INVENTION

The present invention relates to a new and improved construction of insulating bonded masonry or brickwork wherein insulating layers formed of insulating material are arranged between the bricks within the vertical joints disposed essentially parallel to the brickwork plane, and the insulating layers extend in each case at least at one bearing or support joint up to the neighboring brick.

An insulating bonded brickwork of the previously mentioned type is disclosed, for instance, in Swiss Pat. No. 507,425. In this bonded brickwork insulating layers formed of insulating material are arranged in the vertical joints. Since the vertical joints are offset from brick row to brick row, there remains a mortar layer in the bearing joint between the vertical joints of superimposed brick rows. This mortar layer forms a cold bridge between two superimposed bricks, so that there is present an interruption in the insulation layer.

In Austrian Pat. No. 257,885, there is also known to the art masonry or brickwork wherein superimposed bricks have vertical holes which are partially filled with insulating material. The mortar layer of the bearing joint is provided, at that location where two bricks are located above one another with their insulating layers, with an insulating intermediate layer. This intermediate insulation establishes a connection between the insulating layers of the bricks, and thus, interrupts the mortar layer, Hence, while there is precluded the formation of a cold bridge in the mortar layer, still the insulating layer in the bricks is not continuous throughout its entire length, rather is interrupted by material webs of the brick. These material webs form cold bridges which again eliminate the good insulating properties of the insulation layer in the mortar joint, so that this brickwork only possesses limited insulation properties. Moreover, the handling of thin insulation material ledges, which are to be mounted in the bearing or support joints between the mortar layer, is relatively complicated. In the event that the mortar layer is not applied extremely carefully and uniformly at the bearing joints, then the insulation material ledges constitute non-uniform or irregular locations which render questionable faultless laying of the bricks.

SUMMARY OF THE INVENTION

Therefore, it is a primary object of the present invention to provide a new and improved construction of insulating bonded brickwork or masonry of the previously mentioned type, possessing improved insulation properties and not afflicted with the aforementioned drawbacks.

Now in order to implement this object and others which will become more readily apparent as the description proceeds, the insulating bonded masonry or the brickwork of the present development is manifested by the features that the bricks neighboring the insulating layers in vertical direction possess from bearing side to bearing side continuous holes, and at least the holes neighboring the insulating layers are filled with insulating material. The insulating layer located at least at one bearing side is connected with the insulating material of the bricks.

Since insulating layers are arranged both in vertical joints disposed paralled to the brickwork plane between the bricks, and also in holes of the bricks which are continuous from bearing side to bearing side, such type constructed bonded brickwork or masonry contains at least two parallel insulating layers which, in comparison to heretofore constructed brickworks of the same thickness, posses extremely good thermal insulating properties and also sound insulating properties. The few material webs which remain in the bricks between the holes filled with insulating material are just sufficient, without endangering the insulating properties, in order to ensure for moisture absorbtion, vapor diffusion, thermal equilibrium and breathing, as is necessary for a physiologically sound masonry or brickwork.

Additionally, the bonded brickwork of the invention is manifested by its good strength properties. Also, the fire resistance is improved, since the insulating layers are not located at the marginal zones of the bonded brickwork. Additionally, the fabrication of the bonded brickwork is extremely simple since it is unnecessary to employ any special bricks, rather there can be used standard modular bricks and there need not be handled any thin insulating material ledges.

The mortar layer of the bearing joints can additionally be interrupted by constructing the bonded brickwork such that the insulating material of the holes of each brick is arranged to protrude at least at one bearing side of the brick, preferably arranged to penetrate the mortar layer of the bearing joint.

The insulating layer of the vertical joints can be attached directly at the joint side of the bricks in that the insulating layer is connected, for instance adhesively bonded, with joint sides of the bricks. It is also possible to loosely lay insulating strips in the vertical joints during the fabrication of the bonded brickwork in that the insulating layer is formed of insulating strips which are layed in such vertical joints. This construction is particularly advantageous since, on the one hand, such insulating strips are easy to handle, and, on the other hand, when dimensioning the thickness of the mortar layer of the bearing joints there are possible certain tolerances, since the insulating strips can protrude to the next layer joint.

Particularly good insulating properties can be realized if a bonded masonry or brickwork is constructed such that the insulating layer of a brick row is continuous over the length of a brick row, since in this case the insulating layer is not interrupted in the vertical joint of a brick row. The construction of bonded brickwork wherein the insulating layer of a brick row possesses offset sections or portions from brick to brick, affords particularly good strength characteristics.

According to a further aspect of the invention, the insulating layer of the vertical joints can possess a thickness of at least two centimeters, preferably amounting between about five to ten centimeters. Such constitutes a particularly advantageous thickness of the insulating layer of the vertical joints.

According to a further aspect of the invention, the holes filled with insulating material of a brick can be arranged at its longitudinal central plane. Also, the holes filled with insulating material can possess in each case a larger cross-sectional area than the unfilled holes of the bricks. Since the insulating material is arranged in the longitudinal central plane of the brick, it is located in a zone of lesser loading, so that the corresponding holes can be designed to be larger, with the result that the cross-sectional surface or area of the insulating material arranged in the brick can be increased. In this way the insulation coefficient of the brick is improved by increasing the heat path. Equally, the large filled holes prevent loss of mortar during the brick laying work. The holes in the marginal regions to both sides of the holes filled with insulating material can be configured with respect to strength configurations.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
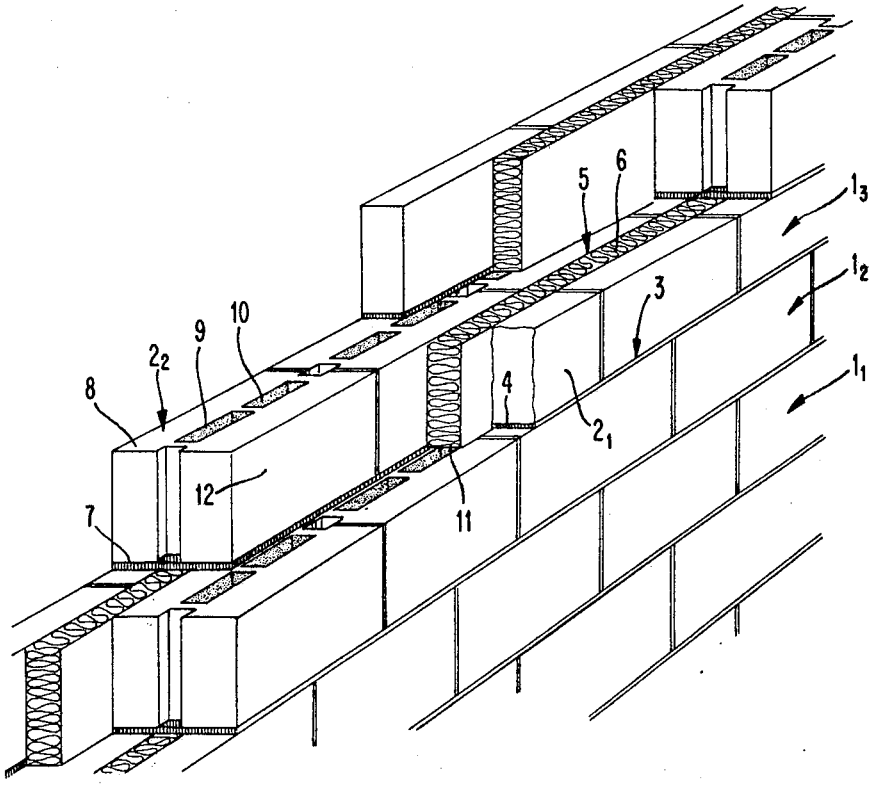
FIG. 1 is a perspective view, partially in broken illustration, of an insulating bonded masonry or brickwork according to the invention.

Describing now the drawings, in FIG. 1 there is shown an insulating bonded brickwork or masonry composed of a number of rows $1_1$, $1_2$, $1_3$ formed of bricks $2_1$, $2_2$, wherein between the different rows $1_1$, $1_2$, $1_3$, there are arranged bearing or support joints 3 formed of mortar 4. In the illustrated embodiment, each row consists of a row of narrower bricks $2_1$ and a row of wider bricks $2_2$, separated from one another by means of a vertical joint 5, in which there is arranged an insulation or insulating layer 6. The wide bricks $2_2$ possess at their longitudinal plane continuous holes or bores 9 or equivalent structure extending from the lower bearing or support side 7 to the upper bearing or support side 8, these holes 9 being filled with an insulating material 10.

The construction of the bonded brickwork or masonry is carried out in such a fashion that the rows of the narrower bricks $2_1$ and the wider bricks $2_2$ are alternately arranged from row to row, so that in each case the insulating layer 6 of the vertical joints 5 are arranged between the holes 9 of the wide bricks $2_2$ filled with insulating material 10. The insulating layers 6 protrude at one side, preferably the lower side, past the bricks $2_1$ and $2_2$ and penetrate through the mortar layer 4, so that they establish a direct connection 11 with the insulating material 10 in the holes 9 of the bricks $2_2$. In contrast to the illustrated exemplary embodiment, the insulating layers of the vertical joints 5 also can protrude upwardly and penetrate through the mortar layer 4 of the bearing joint 3 situated thereabove.

In each case, the insulating layer can consist of sections or portions which are secured to the joint sides 12 of the bricks $2_2$, for instance adhesively bonded therewith. Preferably the insulating layer 6 however consists of a continuous strip which is loosely placed into the vertical joint, as the same has been shown in FIG. 1. The insulating layer in the vertical joints can possess, by way of example, a thickness of at least two centimeters, preferably five to ten centimeters.

In contrast to the illustrated embodiment, the bricks of one row can be formed of mutually alternating narrower bricks and wider bricks.

As a modification of the illustrated embodiment, it is possible that in addition to the protruding insulating layer 6 of the vertical joints 5 for the insulating material 10 in the holes 9 of the bricks to also protrude and to penetrate through the mortar layer 4 of the bearing or support joints 3. The bricks, apart from containing holes filled with insulating material, can posses further unfilled holes. The cross-section of the holes filled with insulating material is however preferably larger than that of the unfilled holes.

The bricks can be formed of the most different materials. Thus, for instance, they can be formed of non-fired materials, such as sand-lime brick, lightweight concrete or the like. Preferably, the bricks are formed of fired material, such as clay, loam, or clay-like masses.

Also, the most different materials can be used for the insulating material, both for the vertical joints and the holes in the bricks. Thus, it is possible to fill the holes with an insulating concrete, such as for instance foam concrete. Particularly suitable, however, are foamed plastics, such as those which contain a large number of closed cells, in order to prevent water vapor diffusion through the entire cross-sectional surface or area of the bricks. Suitable as plastic foams are, by way of example, those formed of urea formaldehyde, polyvinylchloride, polyethylene, polyester, phenolic resins and in partiticular, polyurethane. Such insulating materials also can be used in the form of strips for the vertical joints. Also other insulating materials are suitable, such as for instance those formed of mineral wool.

Figure 2:
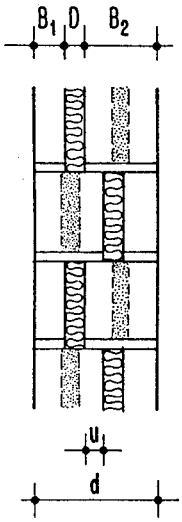
FIGS. 2 to 7 respectively show bonded brickwork or masonry structures of different thickness in vertical longitudinal sectional view.
Figure 3:
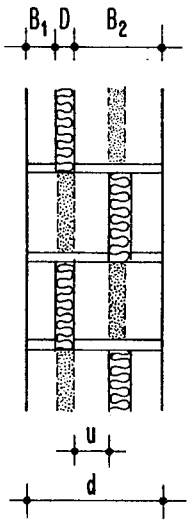
Figure 4:
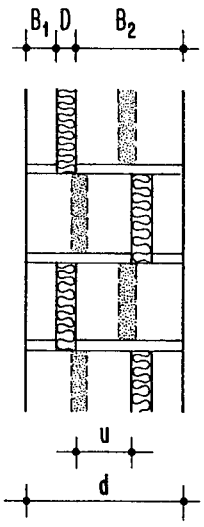
Figure 5:
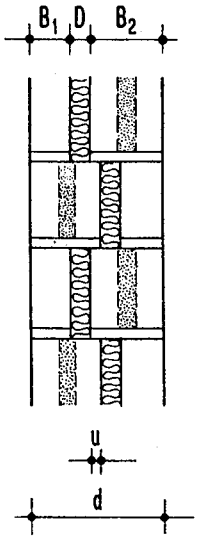
Figure 6:
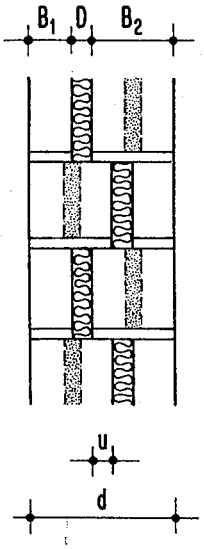
Figure 7:
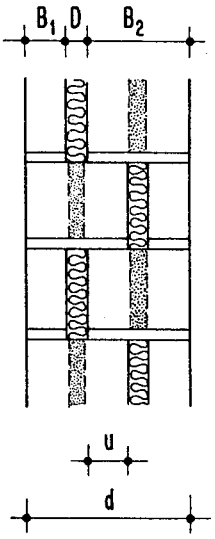

FIGS. 2 to 7 show advantageous bonded masonry or brickworks of different thickness, the values of which have been given in the following Table:

| | | FIG. 2 | FIG. 3 | FIG. 4 | FIG. 5 | FIG. 6 | FIG. 7 |
|---|---|---|---|---|---|---|---|
| Wall Thickness d | [cm] | 30 | 32.5 | 37.5 | 32.5 | 35 | 40 |
| Bonding Mass u | [cm] | 5 | 7.5 | 12.5 | 2.5 | 5 | 10 |
| Narrower Brick Width $B_1$ | [cm] | 7.5 | 7.5 | 7.5 | 10 | 10 | 10 |
| Wider Brick Width $B_2$ | [cm] | 17.5 | 20 | 25 | 17.5 | 20 | 25 |
| Insulating Layer Thickness D | [cm] | 5 | 5 | 5 | 5 | 5 | 5 |

While there are shown and described present preferred embodiments of the invention, it is to be distinctly understood that the invention is not limited thereto, but may be otherwise variously embodied and practiced within the scope of the following claims. Accordingly,

What we claim is:

1. An insulating bonded brickwork comprising:

adjacent rows of substantially vertically arranged bricks forming the brickwork;

each brickwork row comprising a plurality of adjacent bricks arranged to form therebetween substantially vertically extending joints extending substantially parallel to the plane of the brickwork;

each two neighboring vertical brickwork rows containing therebetween bearing joints;

insulating layers formed of insulating material being arranged in said vertically extending joints and located parallel to the brickwork plane and between said bricks;

the insulating layers of at least one bearing joint extending up to neighboring bricks;

the bricks neighboring the insulating layers in vertical direction are conventional hollow bricks having continuous holes extending from bearing joint side to bearing joint side;

at least predetermined ones of the holes neighboring the insulating layers being filled with insulating material; and the insulating layer of the vertical joints connect at least at one bearing joint side with the insulating material in the holes of the bricks.

2. The insulating brickwork as defined in claim 1, wherein:

the insulating layer is composed of insulating strips inserted into the vertical joints.

3. The insulating brickwork as defined in claim 1, wherein:

the insulating layers of the vertical joint is continuous over the length of the brickwork row.

4. The insulating brickwork as defined in claim 1, wherein:

the insulating layer of the vertical joint of a row of bricks has offset portions from brick to brick.

5. The insulating brickwork as defined in claim 1, wherein:

the holes filled with insulating material of a brick are located at its longitudinal central plane.

6. The insulating brickwork as defined in claim 1, wherein:

the holes filled with insulating material have a larger cross-sectional area than unfilled holes of the bricks.

7. The insulating brickwork as defined in claim 1, wherein:

the insulating material of the holes of each brick is protrudingly arranged at least at one bearing joint side of the bricks.

8. The insulating brickwork as defined in claim 2, wherein:

said insulating material penetrates through a mortar layer of the bearing joint.

9. The insulating brickwork as defined in claim 1, wherein:

the bricks have joint sides; and the insulating layers of the vertical joints are connected with predetermined ones of said joint sides of the bricks forming the vertical joint.

10. The insulating brickwork as defined in claim 9, wherein:

said connection comprises an adhesive bond.

11. The insulating brickwork as defined in claim 1, wherein:

the insulating layer of the vertical joints has a thickness of at least two centimeters.

12. The insulating brickwork as defined in claim 11, wherein:

said thickness is in the range of about five to ten centimeters.

13. The insulating brickwork as defined in claim 1, wherein:

said brickwork has a heat transfer coefficient less than 0.5 $W/m^2K$.

14. The insulating brickwork as defined in claim 13, wherein:

said heat transfer coefficient is less than 0.45 $W/m^2K$.

15. An insulating bonded brickwork comprising:

adjacent rows of substantially vertically arranged bricks forming the brickwork;

each brickwork row comprising a plurality of adjacent bricks arranged to form therebetween substantially vertically extending joints extending substantially parallel to the plane of the brickwork;

insulating layers formed of insulating material arranged in said vertically extending joints;

each two neighboring vertical brickwork rows containing therebetween bearing joints;

predetermined ones of the bricks neighboring the insulating layers in vertical direction having continuous holes extending from bearing joint side to bearing joint side;

at least predetermined ones of the holes neighboring the insulating layers being filled with insulating material; and the insulating layers at least at one bearing joint side being connected with the insulating material in the holes of the bricks.

16. An insulating bonded brickwork comprising:

adjacent rows of substantially vertically arranged bricks forming the brickwork;

each brickwork row comprising a row of two different size bricks, one of narrower size than the other, said two different size brick rows being arranged to form therebetween substantially vertically extending joints extending substantially parallel to the plane of the brickwork;

each two neighboring vertical brickwork rows containing therebetween bearing joints;

insulating layers formed of insulating material being arranged in said vertically extending joints and located parallel to the brickwork plane and between said bricks the insulating layers of at least one bearing joint extending up to neighboring bricks;

the bricks neighboring the insulating layers in vertical direction are conventional hollow bricks having continuous holes extending from bearing joint side to bearing joint side;

at least predetermined ones of the holes neighboring the insulating layers being filled with insulating material; and the insulating layers of the vertical joints connect at least at one bearing joint side with the insulating material in the holes of the bricks.

* * * * *